US010493647B2

(12) United States Patent
Bagley

(10) Patent No.: US 10,493,647 B2
(45) Date of Patent: Dec. 3, 2019

(54) WEDGER

(71) Applicant: Progressive International Corporation, Kent, WA (US)

(72) Inventor: Justin Bagley, Seattle, WA (US)

(73) Assignee: Progressive International Corporation, Kent, WA (US)

( * ) Notice: Subject to any disclaimer, the term of this patent is extended or adjusted under 35 U.S.C. 154(b) by 0 days.

(21) Appl. No.: 15/923,311

(22) Filed: Mar. 16, 2018

(65) Prior Publication Data

US 2018/0264673 A1 Sep. 20, 2018

Related U.S. Application Data

(60) Provisional application No. 62/472,395, filed on Mar. 16, 2017.

(51) Int. Cl.

| | |
|---|---|
| ***B26D 3/26*** | (2006.01) |
| ***B26D 7/06*** | (2006.01) |
| ***B26D 3/24*** | (2006.01) |
| ***B26D 5/10*** | (2006.01) |

(52) U.S. Cl.

CPC ..... *B26D 3/26* (2013.01); *B26D 3/24* (2013.01); *B26D 5/10* (2013.01); *B26D 7/0608* (2013.01); *B26D 2210/02* (2013.01)

(58) Field of Classification Search

CPC ... B26D 3/26; B26D 3/24; B26D 5/10; B26D 7/0608; B26D 2210/02

See application file for complete search history.

(56) References Cited

U.S. PATENT DOCUMENTS

| | | | | | |
|---|---|---|---|---|---|
| 2,329,918 | A * | 9/1943 | Leavens | B26D 3/26 | 30/303 |
| 2,647,549 | A * | 8/1953 | Koch | B26D 3/26 | 83/471.2 |
| 3,830,151 | A * | 8/1974 | Gerson | B26D 3/26 | 83/435.15 |
| 4,569,280 | A * | 2/1986 | D'Ambro | B26D 3/26 | 83/435.15 |
| 5,142,973 | A * | 9/1992 | Tur | B26D 3/26 | 83/588 |
| 5,337,480 | A * | 8/1994 | Codikow | B26D 1/0006 | 30/114 |
| 5,363,756 | A * | 11/1994 | Muro | B26D 1/0006 | 83/435.15 |
| 5,421,249 | A * | 6/1995 | Repisky | A23N 4/00 | 83/435.19 |
| 5,771,771 | A * | 6/1998 | Gagliardi, Jr. | B26D 3/08 | 83/620 |
| D415,937 | S * | 11/1999 | Robinson | D7/673 | |
| 6,401,605 | B1 * | 6/2002 | Repac | A47J 19/06 | 83/437.2 |

(Continued)

*Primary Examiner* — Sean M Michalski

(74) *Attorney, Agent, or Firm* — Lowe Graham Jones PLLC

(57) ABSTRACT

A wedger includes a housing and a plunger. The housing includes an interior blade assembly and handles extending laterally away from the housing. The plunger and housing cooperate to enable the plunger to push a food item through the blade assembly and the housing. The inclusion of the handles makes the wedger invertible, so that the housing may be pushed downward toward the plunger by grasping the handles.

11 Claims, 9 Drawing Sheets

(56) References Cited

U.S. PATENT DOCUMENTS 6,596,329 B1 * 7/2003 D'Ambro, Sr. ..... A23N 7/08 426/481
7,086,155 B2 * 8/2006 Chan ..... A47J 9/005 30/114
7,258,053 B2 * 8/2007 Suer ..... B26B 3/04 30/114
7,587,968 B1 * 9/2009 Roberts ..... B26D 3/185 83/404.3
D605,478 S * 12/2009 Melton ..... D7/673
D649,413 S * 11/2011 Coursey ..... D7/673
8,046,921 B2 * 11/2011 Mastroianni ..... A47J 25/00 30/113.2
D650,246 S * 12/2011 Harris ..... D7/673
8,186,265 B2 * 5/2012 Popeil ..... A47J 37/1209 99/407
8,365,657 B2 * 2/2013 Lee ..... A23N 1/00 241/278.1
8,495,941 B2 * 7/2013 Farid ..... B26D 3/185 30/114
D687,267 S * 8/2013 Harris ..... D7/673
8,555,763 B2 * 10/2013 Farid ..... B26D 3/185 30/114
D702,512 S * 4/2014 Harris ..... D7/673
8,863,391 B2 * 10/2014 Bagley ..... B26D 1/547 30/114
9,242,384 B2 * 1/2016 Frenkel ..... A47J 9/003
D761,612 S * 7/2016 Darnell ..... D7/354
9,622,620 B2 * 4/2017 Silberberg ..... A47J 43/28
D795,660 S * 8/2017 Lowetz ..... D7/673
D799,282 S * 10/2017 Maslana ..... D7/673
9,801,399 B2 * 10/2017 Romano ..... A47J 43/20
10,011,032 B2 * 7/2018 Repac ..... B26D 7/00
10,183,410 B2 * 1/2019 Bagley ..... B26D 3/26
2003/0079616 A1 * 5/2003 Barnard ..... A23N 7/08 99/537
2005/0280228 A1 * 12/2005 Fernandes ..... B25H 1/00 280/47.35
2007/0044619 A1 * 3/2007 Farid ..... B26D 3/26 83/620
2007/0215736 A1 * 9/2007 Young ..... B26D 1/0006 241/292.1
2007/0264418 A1 * 11/2007 Young ..... B26D 1/0006 426/637
2008/0034643 A1 * 2/2008 Chen ..... A01M 1/04 43/112
2009/0282990 A1 * 11/2009 Farnum ..... B26B 3/04 99/537
2012/0017779 A1 * 1/2012 Abfall ..... A47J 25/00 99/538
2012/0102760 A1 * 5/2012 Hauser ..... B26D 3/26 30/302
2012/0131800 A1 * 5/2012 Hauser ..... B26D 1/30 30/124
2017/0190066 A1 * 7/2017 Fastabend ..... B26D 1/03
2017/0273868 A1 * 9/2017 Wang ..... A61J 7/0007
2018/0154536 A1 * 6/2018 Repac ..... B26D 3/185

* cited by examiner

WEDGER

PRIORITY CLAIM

This application claims the benefit of U.S. provisional application No. 62/472,395, filed Mar. 16, 2017, the contents of which are incorporated by reference.

FIELD OF THE INVENTION

This application relates to devices for slicing fruits and vegetables.

BACKGROUND OF THE INVENTION

Wedge slicers are commonly available for use in slicing fruits or vegetables. For example, a typical wedger includes an outer ring with an interior blade assembly which may divide the interior space into six or more wedges. A user grasps the wedger by peripheral handles and presses it downward against an item such as a potato to slice it into wedges. This arrangement can be difficult and awkward to use, in part because the potato or other item cannot be held by the user while also holding the wedger. The food item may roll around and the user may have difficulty using it. A wedger of this sort is also ineffective for longer foods, such as carrots or cucumbers, because there is no practical way to hold such a vegetable in a stable manner while also slicing it with the wedger.

SUMMARY OF THE INVENTION

A preferred wedger includes a housing having an upper portion and a lower portion, the housing defining a central axis from the upper portion to the lower portion and forming a tube having an upper opening and a lower opening.

In one version, the housing has a pair of handles extending laterally away from the housing at a location between the upper portion and the lower portion.

A blade assembly may be positioned within the housing and supported by the housing between the upper portion and the lower portion, the blade assembly including a plurality of blades dividing the interior space within the housing into a plurality of sections.

In one example, a housing guide is positioned on the housing.

A plunger having an upper end terminating in an abutment and a lower end terminating in a plurality of feet is configured to interact with the housing. In one example, the plurality of feet are configured to be received within the plurality of sections when the plunger moves axially in a direction from the upper portion of the housing toward the lower portion of the housing.

In a preferred version, a plunger guide is positioned on the plunger, wherein, when the plunger is inserted into the housing, the plunger guide engages the housing guide to prevent rotational movement of the plunger with respect to the housing when the plunger moves axially into the housing.

In use, when a food item is inserted into the housing, movement of the plunger axially in a direction from the upper portion toward the lower portion will push the food item through the blade assembly and out the lower portion of the housing.

Alternatively, in use, when a food item is placed atop the plunger with the plunger cap resting on a horizontal surface, movement of the housing axially in a direction toward the plunger will push the food item through the blade assembly and out the lower portion of the housing.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
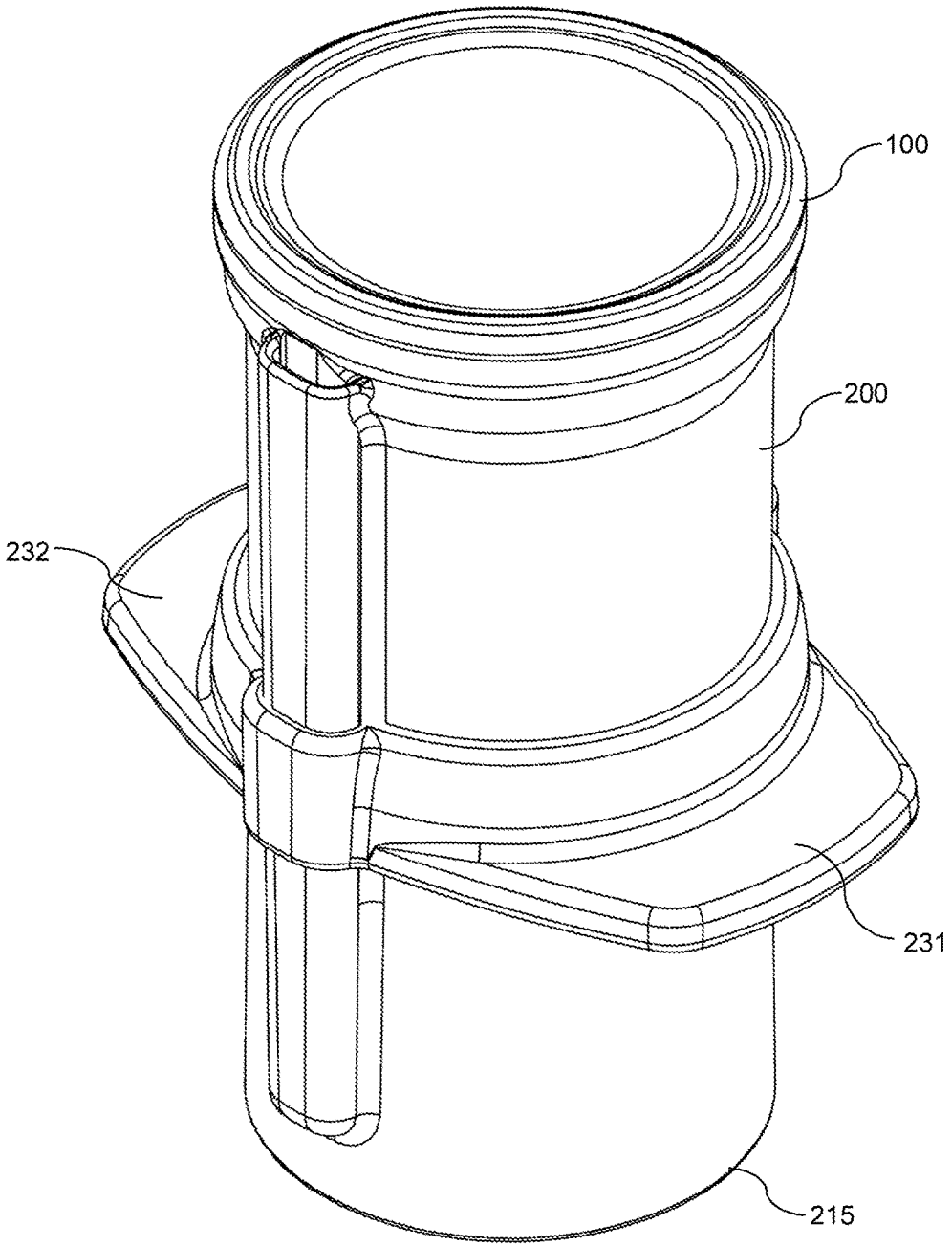
FIG. 1 is a top perspective view of a preferred wedger.

A preferred wedger includes a plunger or pusher 100 and a housing 200 having a number of internal blades. In general, the pusher is configured to be received within the housing in order to push a food item through the housing where it will encounter the blades and be sliced accordingly. As illustrated in FIG. 1, the plunger is positioned within the housing and inserted all the way to the farthest point of insertion.

Figure 3:
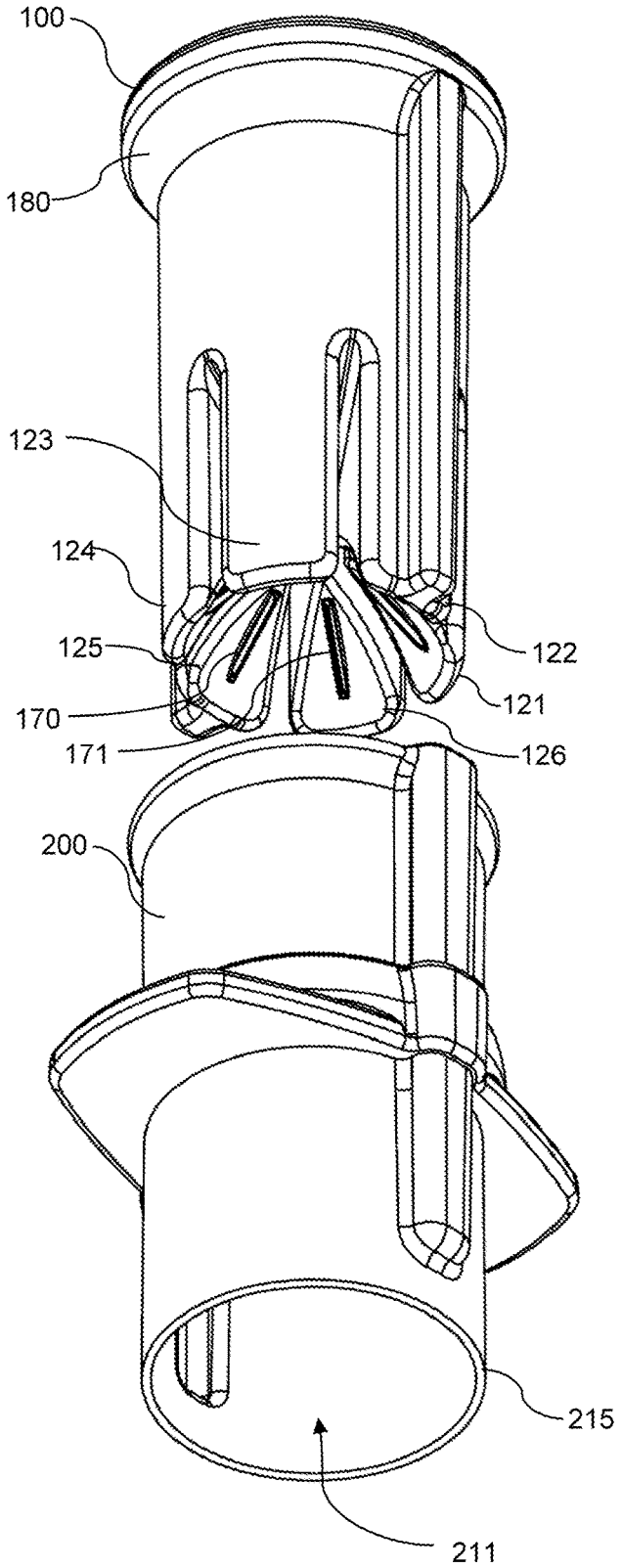
FIG. 3 is a bottom perspective exploded view of a preferred wedger.
Figure 4:
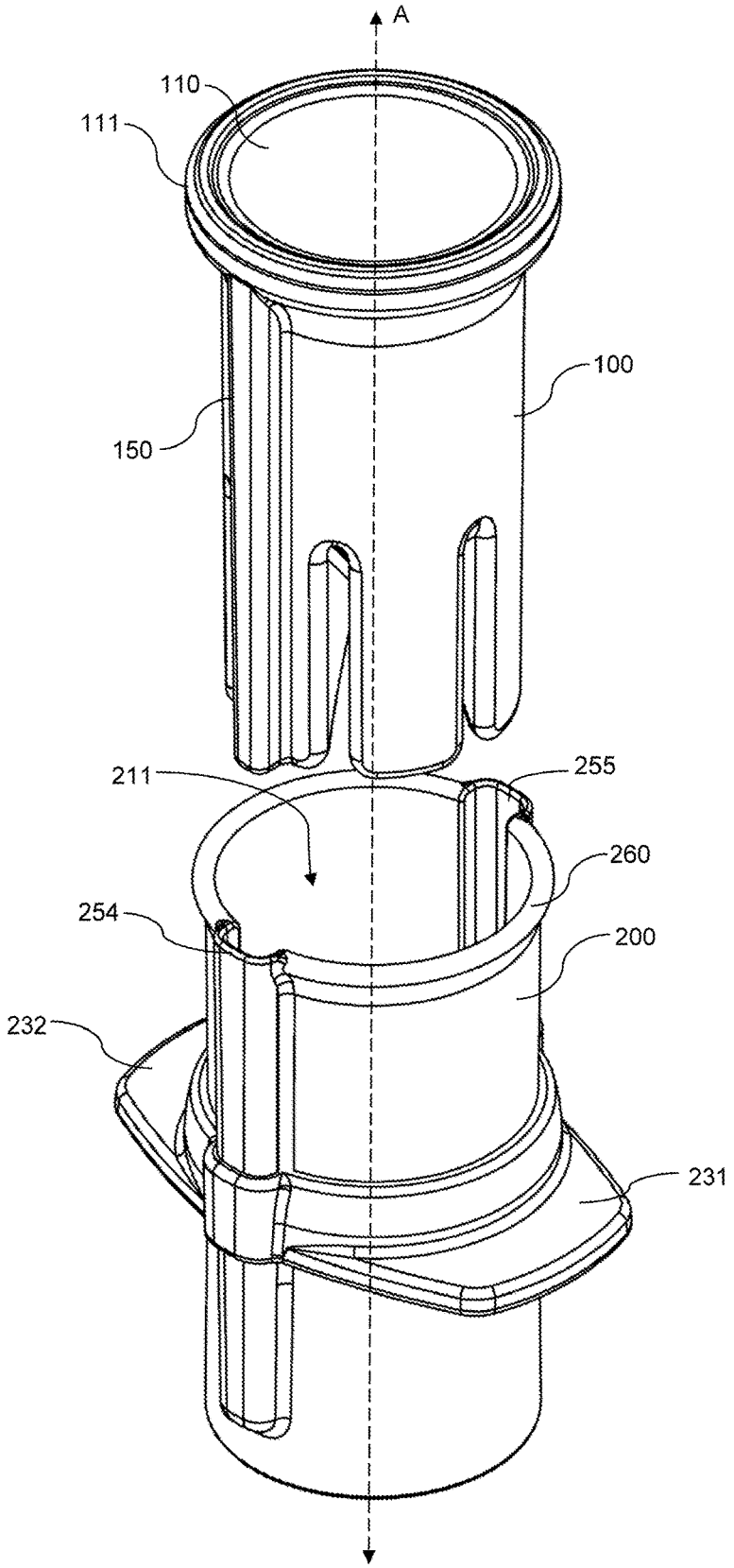
FIG. 4 is a top perspective exploded view of a preferred wedger.
Figure 5:
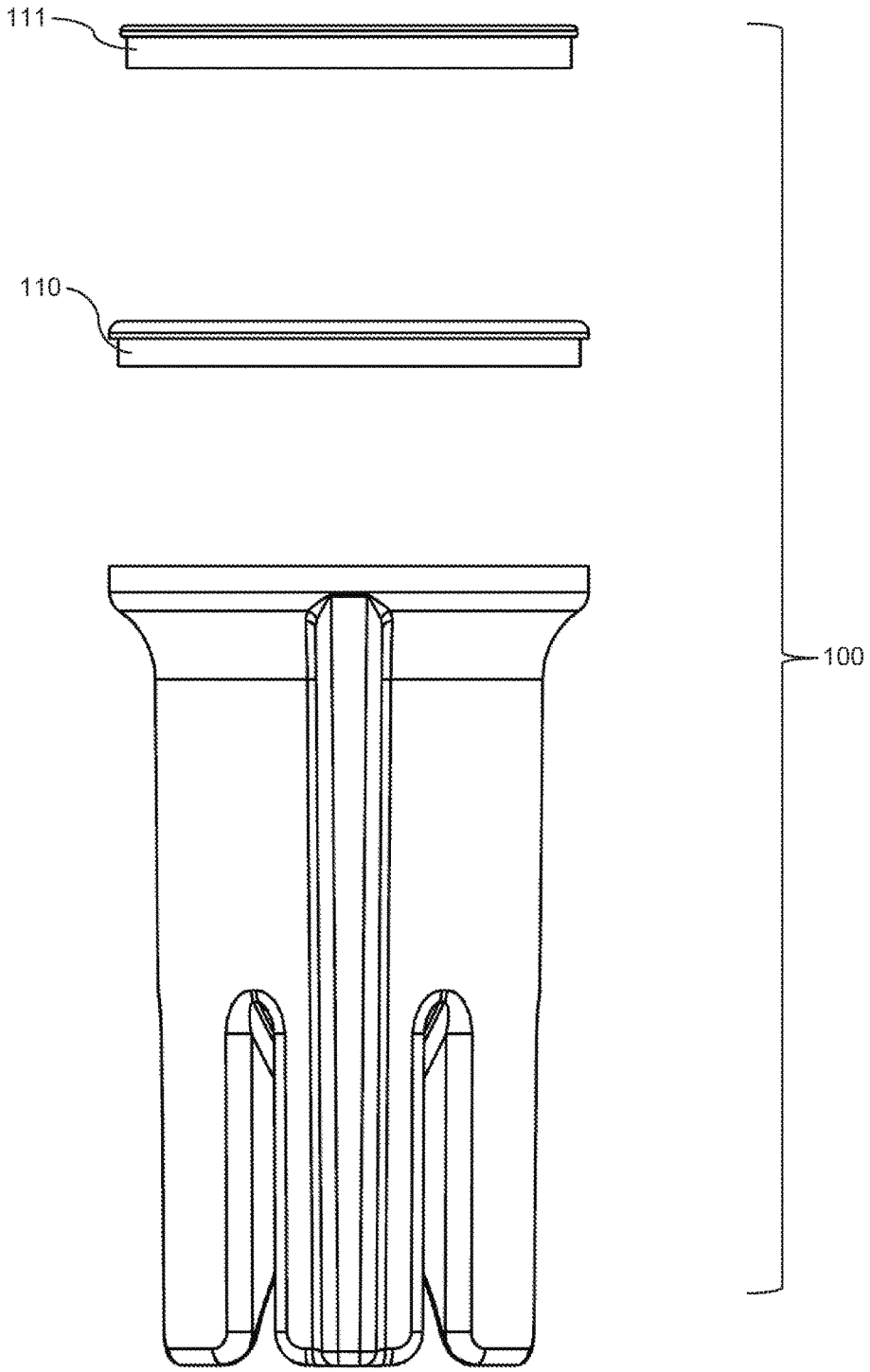
FIG. 5 is a front elevational exploded view of a plunger for use with a preferred wedger.

The housing is configured as an upper portion and a lower portion, and most preferably with an upper tube 210, a lower tube 220, and a center ring 230 positioned between the upper tube and the lower tube. Each of the upper and lower tubes are substantially upright cylinders, having an open top and an open bottom so that the plunger and a food item may be inserted into an opening 211 in the upper tube (see FIG. 4), and a food item may exit an opening 221 in the lower tube (see FIG. 3). As indicated in the exploded view of FIG. 6, the upper tube 210 joins to the upper end of the center ring 230, while the lower tube 220 joins to the lower end of the center ring to form the housing, thereby forming a housing configured as an upright cylinder having an open top and open bottom but with a centrally located center ring. As illustrated, the preferred housing is assembled from three distinct pieces which are glued, sonic welded, or otherwise joined together. In alternate versions they may be produced using fewer or more pieces. Most preferably, the upper and lower tube are transparent, and formed from a plastic material.

The center ring includes a pair of handles 231, 232, preferably formed as peripheral flanges extending radially outward from the center ring and positioned diametrically opposite one another. The handles are sized and configured to allow a user to grasp the housing to either stabilize it when moving the pusher through the housing, or to use it in an opposite direction in which the pusher is stable and the housing is moved axially with respect to the pusher.

Figure 6:
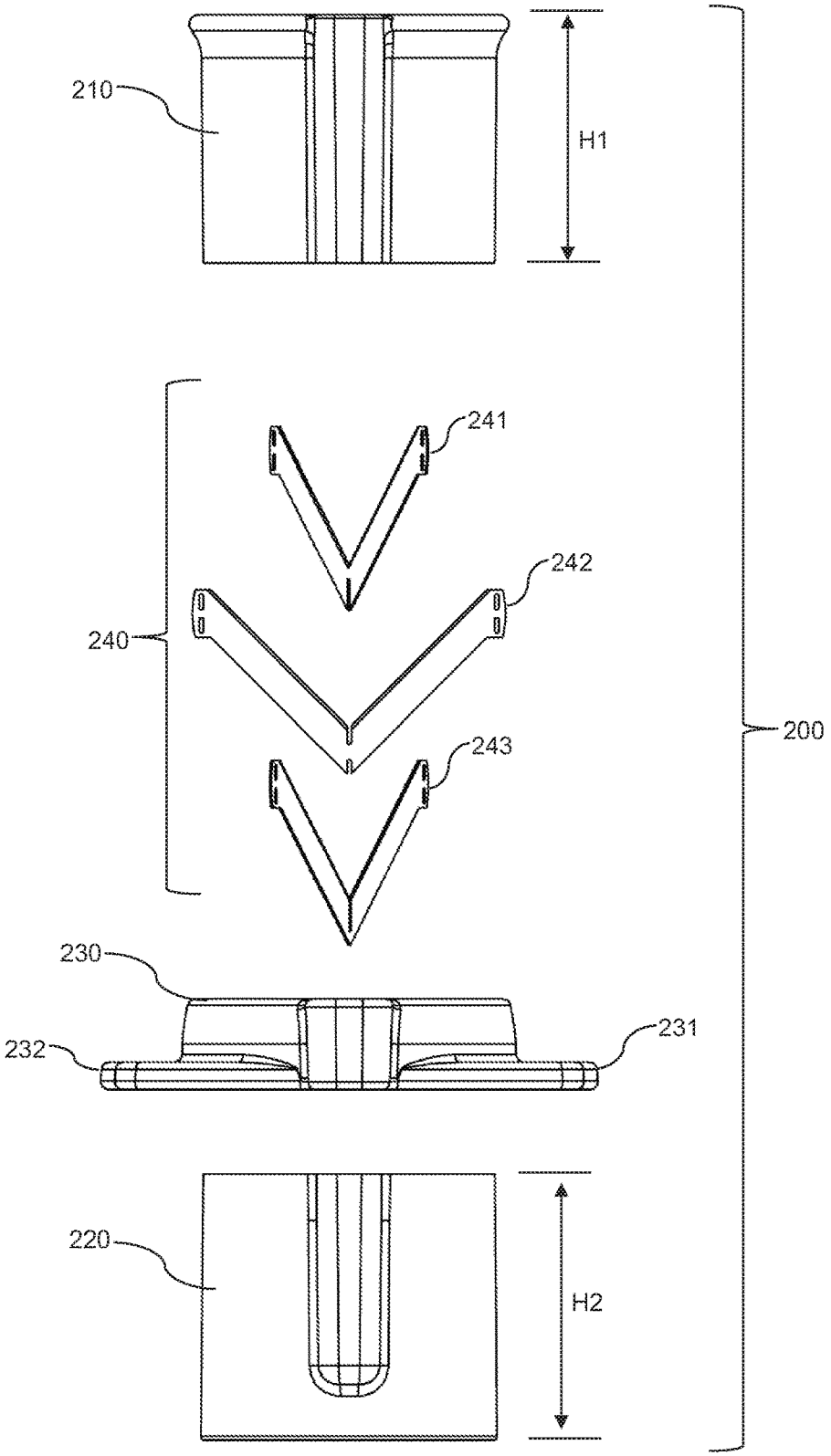
FIG. 6 is a front elevational exploded view of a housing for use with a preferred wedger.
Figure 7:
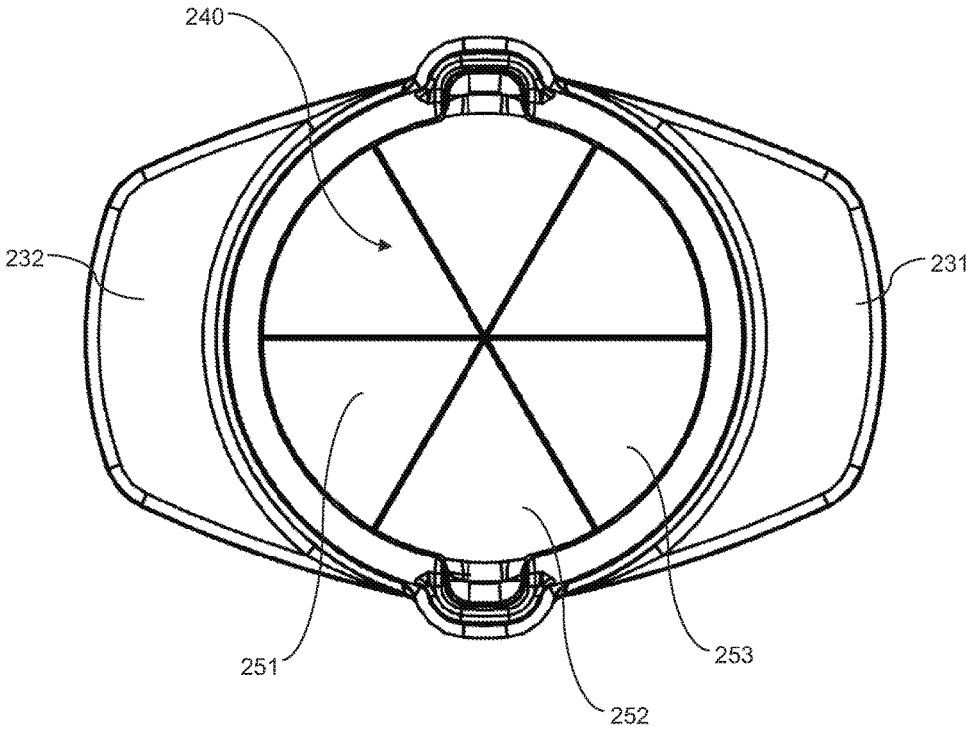
FIG. 7 is a top plan view of a housing for use with a preferred wedger.

The center ring includes a blade assembly 240, shown in the top plan view of FIG. 7, and in the exploded view of FIG. 6. In the preferred version includes three separate V-blades

241, 242, 243 having notches at the apex of the V to enable the blades to join to one another at the apexes. Outer ends of the blade assembly (that is, the farthest extent of the upright of each blade) are mounted to the perimeter of the center ring. In the illustrated example, the apex of the V is oriented toward the lower tube, so that the upright of each of the blades in the blade assembly is mounted to the center ring and the blades each extend downwardly into the lower tube 220, with no portion of the blade extending upward into the upper tube. Most preferably, the sharpened ends of the blades face upward toward the upper tube. In other versions, the blades may be straight, rather than V-shaped, so that they extend directly across the center ring, perpendicular to a central axis extending through the center of the center ring. As shown in FIG. 7, the blade assembly divides the interior space of the housing into a plurality of sections, e.g., 251, 252, 253.

The housing is formed with a height to allow vegetables to be received within the housing, and in one version each of the upper tube and lower tube is formed with a height H1, H2 which is at least one inch in height. In other versions H1 and H2 are two or more inches, or three or more inches, in height. In the illustrated example the center ring is located at the center of the overall height of the housing, such that the upper tube and the lower tube each have the same height. Consequently, the handles extend outwardly at a central location along the housing. In other versions the center ring may be positioned higher or lower, so that one of the upper or lower tube is taller than the other. In a preferred example, the handle is at a location such that at least one third of the housing height is above the handle, and at least one third of the housing height is below the handle.

The housing further includes a housing guide configured to allow the pusher to move axially within the housing, along an axis extending through the center of the upper tube, the apex of the blades, and the center of the lower tube. In the preferred example, the housing guide is formed as a first channel 254 and a second channel 255, each of the first and second channels extending in a direction parallel to the central axis A of the wedger (see FIG. 4), and being positioned on the sidewalls of the housing 200. Though two channels are preferred, in other version one channel, or more than two channels, may be used.

The upper tube 210, and therefore the housing, terminates in an upper rim 260 which serves as a seat for the pusher when the pusher is inserted fully into the housing. In one example, the upper rim is flared outwardly with respect to the diameter of the upper tube.

Figure 2:
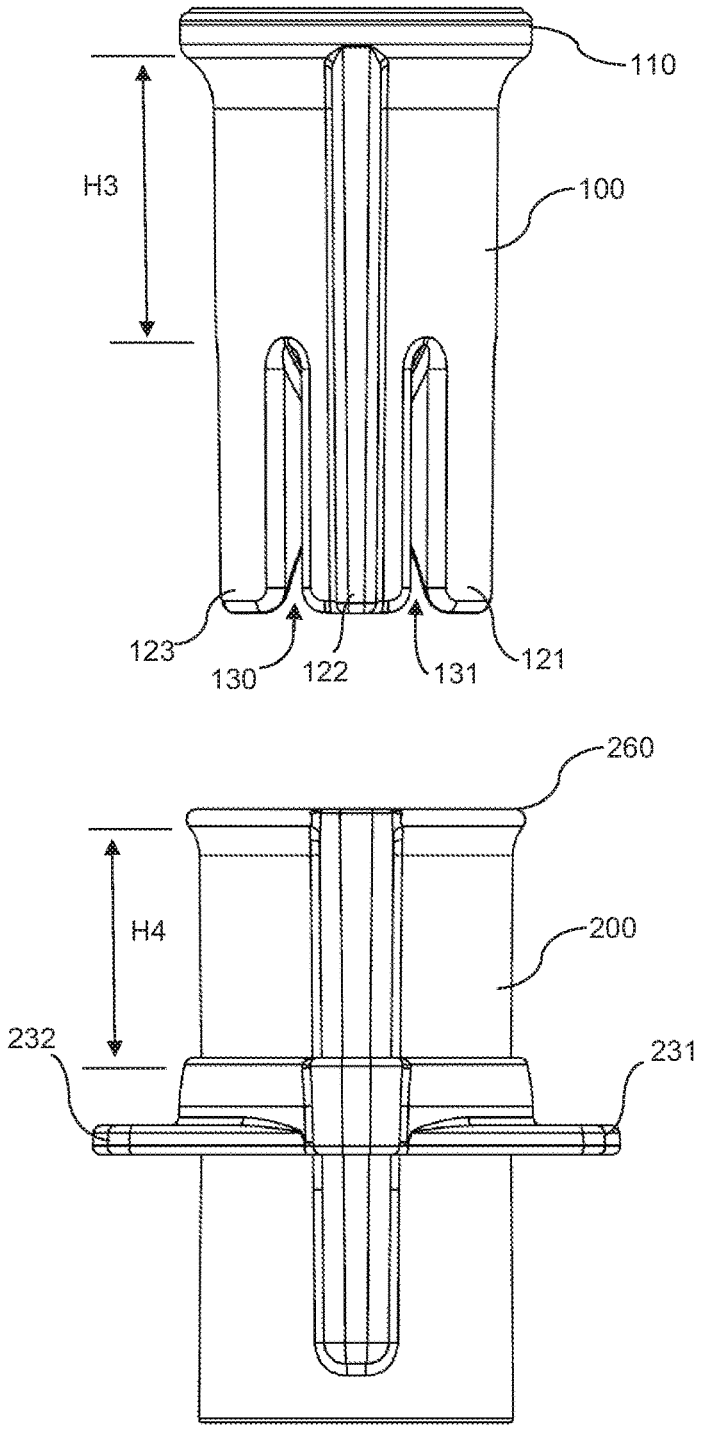
FIG. 2 is a front elevational exploded view of a preferred wedger.

The pusher is formed as an elongated body, extending from an upper cap 110 to a plurality of lower feet e.g. 121, 122, 123 at an opposing lower end of the pusher (see FIG. 2). The pusher preferably has an outer surface extending between the feet and the cap, in which the outer surface is complementary to the interior sidewalls of the housing, so that that the pusher can slide axially within the housing.

The upper cap of the pusher may further include an elastomeric ring 111 attached to the upper end of the cap. In other versions, a differently shaped elastomeric surface may be attached. The elastomeric surface enables the pusher to be inverted with the end cap resting on a horizontal surface, hindering sliding of the pusher when in this position.

The lower feet are separated from one another by a series of slots e.g. 130, 131, with the slots being configured and positioned to receive the blades from the blade assembly. Thus, where the blade assembly includes three blades extending across the housing, thereby dividing the housing into six sections (120-125; see FIG. 3), the pusher preferably includes six slots dividing the lower end of the housing into six feet. Each of the feet in such a configuration preferably are defined by a wedge shape, as viewed from the bottom, to fit relatively within the entire wedge shapes defined by the intersecting blades of the housing. See, for example, section 126 in FIG. 3, terminating in a foot having a wedge shape. The feet may terminate in one or more spikes or fins e.g. 170, 171, to serve as points for engaging a food item by the pusher for a more stable grip.

Figure 8:
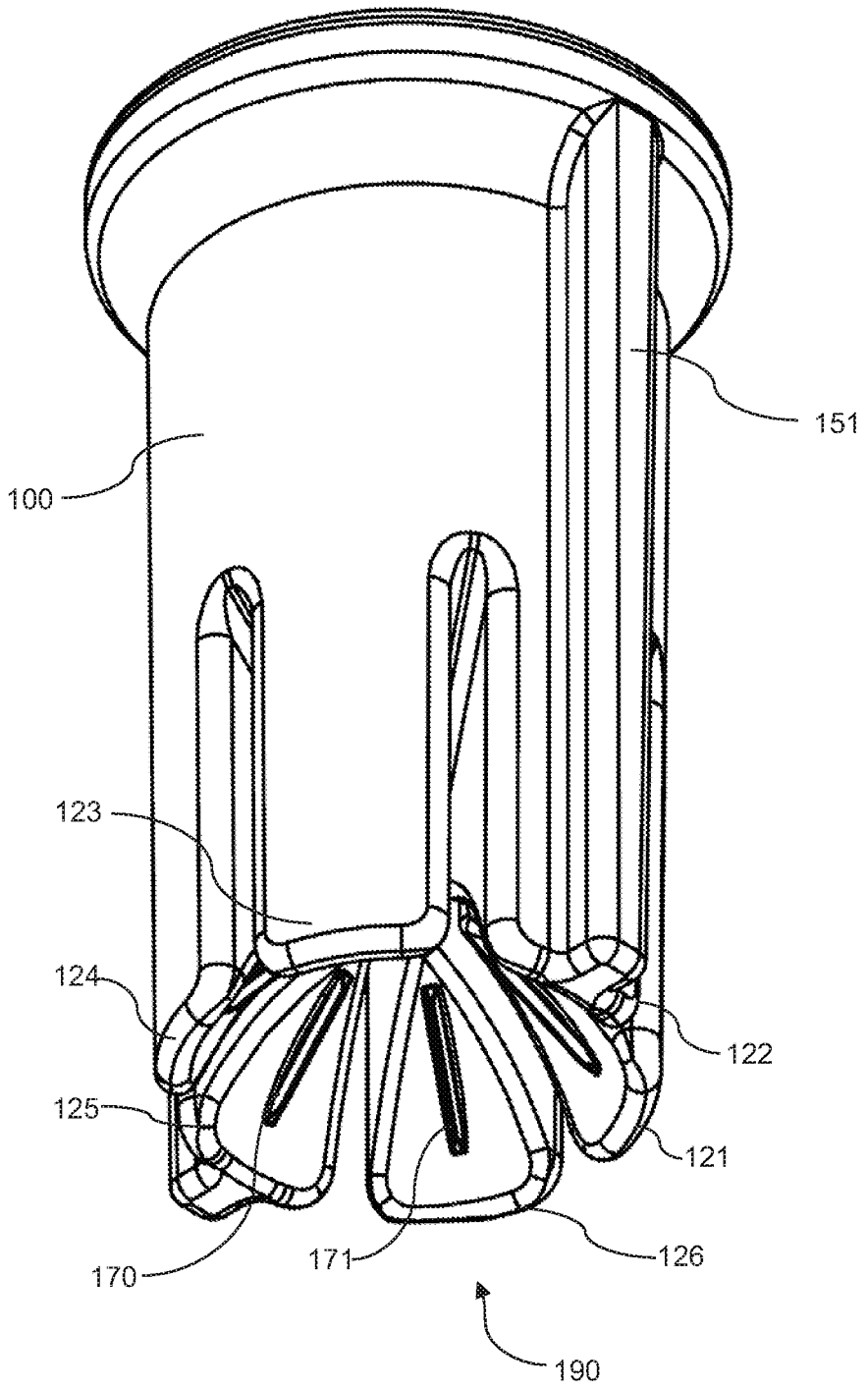
FIG. 8 is a bottom perspective view of a plunger for use with a preferred wedger.

The upper end of the pusher, adjacent the cap, is preferably flared outwardly to form an upper abutment 180 to allow the pusher to seat atop the housing when it is pushed all the way into the housing. The abutment of the rim of the cap is wider than the flared upper rim of the housing, thereby serving as a stop against further axial travel of the pusher with respect to the housing. Most preferably, the pusher and housing are dimensioned so that the pusher cannot travel into the housing to a point where the pusher contacts the blades, and further such that, when the pusher is fully inserted the lower feet do not extend beyond a lower rim 215 of the housing. Thus, as seen in FIG. 2, the height H3 from the upper edge of the slots to the top of the upper abutment is preferably slightly less than a corresponding height H4 from the upper rim of the housing to the upper edge of the blades The distal ends of the feet preferably combine to form a lower end concavity 190 as best seen in FIG. 8, which in one version is shaped as a nearly hemispherical concavity. Each of the feet therefore terminates in a distal edge at the perimeter of the pusher, and includes an interior surface curving inward toward a center of the pusher. This concavity enables the distal end of the pusher to engage a rounded food item such as a potato, a tomato, or an end of a cucumber.

The pusher further includes a pusher guide configured to cooperate with the housing guide formed in the housing. In the preferred version, the pusher includes a pair of diametrically opposed ribs 150, 151 extending axially along the length of the pusher, substantially from the upper abutment to the distal end of the feet. In other versions, the pusher may have one or more channels and one or more ribs may be formed in the housing. Likewise, yet other combinations of engaging surfaces may be used to ensure axial travel of the pusher with respect to the housing, and to ensure proper alignment so that the slots between the feet are aligned with the blades.

In use, a user may place a food item into the housing where it would be supported by the blades, then insert the pusher and urge the pusher axially into the housing, engaging the guide (such as the ribs and channels) to ensure alignment of the housing with the pusher. As the pusher is forced into the housing, the food item is pushed into and through the blades where it is cut into wedges.

Figure 9:
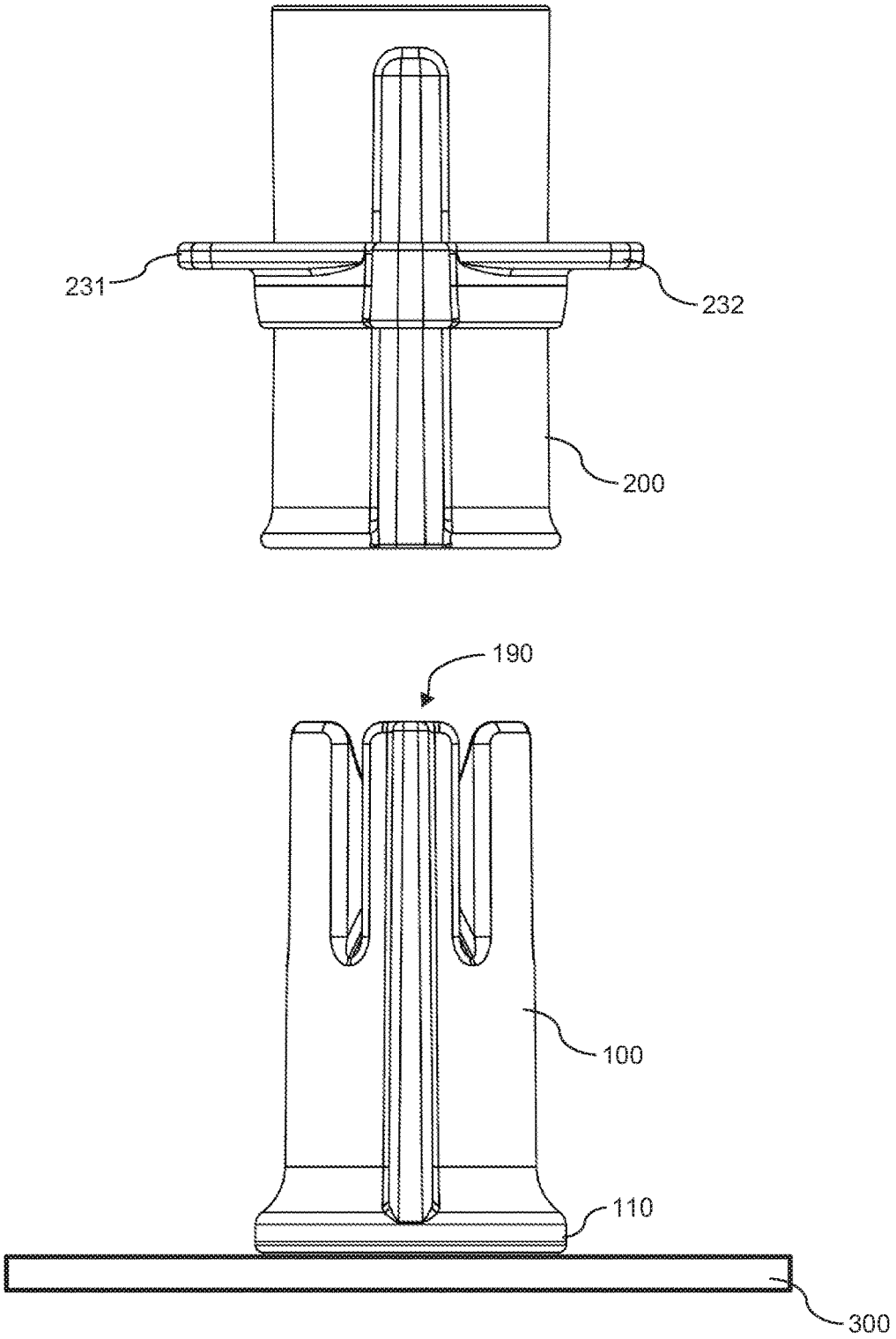
FIG. 9 is a front elevational view of a preferred wedger, shown in an optional position for use on a horizontal surface.

Alternatively, the pusher may be placed on a horizontal surface such as a countertop 300 such as illustrated in FIG. 9, in which the cap 110 is resting on the surface and the feet extend upwardly. A food item may be placed in the concavity 190 formed in the feet so that the food item is stably supported within the concavity. Then the housing 200 is brought to the pusher, surrounding the food item and axially moved toward the pusher while the user grasps the handles to push the housing downward. As the housing is moved axially, the blades encounter the food item and cut it into wedges.

As described above, the blades of the housing are more safely located inside the tubes of the housing, keeping them farther away from fingers during operation of the device.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims.

I claim:

1. A wedger, comprising:

a housing extending between an upper rim and a lower rim, the housing forming a tube having an upper opening at the upper rim and a lower opening at the lower rim, a central axis being defined from a center of the upper opening to a center of the lower opening;

a pair of handles extending laterally away from the housing at a location between the upper rim and the lower rim;

a blade assembly positioned within the housing and supported by the housing between the upper rim and the lower rim, the blade assembly including a plurality of blades dividing the interior space within the housing into a plurality of sections;

a housing guide positioned on the housing;

a plunger having an upper end terminating in an abutment and a lower end terminating in a plurality of feet, the plurality of feet being sized and positioned on the plunger to be received within the plurality of sections when the plunger moves axially in a direction from the upper rim of the housing toward the lower rim of the housing;

a plunger guide positioned on the plunger, wherein, when the plunger is inserted into the housing, the plunger guide engages the housing guide to prevent rotational movement of the plunger with respect to the housing when the plunger moves axially into the housing;

whereby when a food item is inserted into the housing, movement of the plunger axially in a direction from the upper rim toward the lower rim will push the food item through the blade assembly and out the lower rim of the housing; and wherein when the plunger is inserted fully into the housing, the abutment of the plunger contacts the upper rim of the housing and the plurality of feet do not extend beyond the lower rim of the housing.

2. The wedger of claim 1, wherein the plunger further comprises a cap having an elastomeric surface at the upper end of the plunger.

3. The wedger of claim 2, further comprising a central ring, the handles being attached to and extending away from the central ring, and the blade assembly being attached to and spanning an interior space defined by the central ring.

4. The wedger of claim 2, wherein the housing guide comprises a pair of channels and the plunger guide comprises a pair of ribs.

5. The wedger of claim 2, wherein the plurality of feet form a concavity at the lower end of the plunger.

6. The wedger of claim 5, further comprising a spike positioned on each of the plurality of feet.

7. A method of using a wedger, comprising:

obtaining a wedger in accordance with claim 1;

placing the plunger on a horizontal surface;

placing a food item atop the plunger; and moving the housing axially toward the plunger to surround the food item and the plunger until the food item is sliced by the blade assembly.

8. A wedger, comprising:

a tubular housing extending between an open upper rim and an open lower rim;

a blade assembly positioned within the housing and supported by the housing between the upper rim and the lower rim, the blade assembly dividing the interior space within the housing into a plurality of sections;

a housing guide positioned on the housing;

a plunger extending between an upper end and a lower end, the lower end terminating in a plurality of feet, the plurality of feet being sized and positioned on the plunger to be received within separate ones of the plurality of sections when the plunger moves axially in a direction from the upper rim of the housing toward the lower rim of the housing;

a plunger guide positioned on the plunger, wherein when the plunger is inserted into the housing, the plunger guide engages the housing guide to prevent rotational movement of the plunger with respect to the housing when the plunger moves axially into the housing;

the tubular housing having a first abutment and the plunger having a second abutment, wherein when the plunger is inserted fully into the housing, the first abutment contacts second abutment to prevent further travel of the plunger in a direction from the upper rim toward the lower rim, wherein the plurality of feet do not extend beyond the lower rim of the housing when the plunger is inserted fully into the housing;

whereby when a food item is inserted into the housing, movement of the plunger axially in a direction from the upper rim toward the lower rim will push the food item through the blade assembly and out the lower rim of the housing.

9. The wedger of claim 8, wherein the plunger further comprises a cap, the second abutment being positioned on the cap.

10. The wedger of claim 9, wherein the housing guide comprises a pair of channels and the plunger guide comprises a pair of ribs.

11. The wedger of claim 10, wherein the pair of channels are formed in a sidewall of the housing.

* * * * *